US008998200B2

(12) United States Patent
Moto

(10) Patent No.: US 8,998,200 B2
(45) Date of Patent: Apr. 7, 2015

(54) MEDIUM FEEDING DEVICE WITH ROTATIONAL DIFFERENCE GENERATING UNIT

(71) Applicant: PFU Limited, Ishikawa (JP)

(72) Inventor: Satoru Moto, Ishikawa (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 13/748,304

(22) Filed: Jan. 23, 2013

(65) Prior Publication Data

US 2013/0234387 A1 Sep. 12, 2013

(30) Foreign Application Priority Data

Mar. 9, 2012 (JP) ..... 2012-053662

(51) Int. Cl.
*B65H 7/02* (2006.01)
*B65H 9/00* (2006.01)

(52) U.S. Cl.
CPC ..... *B65H 9/002* (2013.01); *B65H 2403/483* (2013.01)

(58) Field of Classification Search
CPC ..... B65H 9/002
USPC ..... 271/228, 226, 270
See application file for complete search history.

(56) References Cited

U.S. PATENT DOCUMENTS

| | | | | |
|---|---|---|---|---|
| 6,273,418 | B1 | 8/2001 | Fujikura et al. | |
| 6,345,817 | B1 * | 2/2002 | Kakegawa et al. | 271/270 |
| 6,520,497 | B2 | 2/2003 | Tamura | |
| 6,830,244 | B2 | 12/2004 | Komatsu | |
| 8,814,160 | B2 * | 8/2014 | Chen | 271/228 |
| 2006/0261540 | A1 * | 11/2006 | Loiselle et al. | 271/228 |

FOREIGN PATENT DOCUMENTS

| | | | |
|---|---|---|---|
| JP | 63230451 | A * | 9/1988 |
| JP | 11-189355 | A | 7/1999 |
| JP | 2001-220029 | A | 8/2001 |
| JP | 2003-081475 | A | 3/2003 |
| JP | 2005-187113 | A | 7/2005 |
| JP | 2006-151623 | A | 6/2006 |

* cited by examiner

*Primary Examiner* — Gerald McClain
(74) *Attorney, Agent, or Firm* — McDermott Will & Emery LLP

(57) ABSTRACT

A medium feeding device includes a feeding roller that conveys a medium in a conveying direction, and a brake roller that includes rollers that are arranged to be rotatable around one shaft and cause a conveyance load to act on the medium that has entered between the feeding roller and the rollers. The rollers are arranged to press the feeding roller with a predetermined pressure. The medium feeding device further includes a rotational difference generating unit that generates a rotational difference between the rollers so that the conveyance load acting on the medium by the rollers becomes even.

5 Claims, 12 Drawing Sheets

MEDIUM FEEDING DEVICE WITH ROTATIONAL DIFFERENCE GENERATING UNIT

CROSS-REFERENCE TO RELATED APPLICATIONS

This application is based upon and claims the benefit of priority from Japanese Patent Application No. 2012-053662, filed on Mar. 9, 2012, the entire contents of which are incorporated herein by reference.

BACKGROUND OF THE INVENTION

1. Field of the Invention

The present invention relates to a medium feeding device.

2. Description of the Related Art

In medium feeding devices having a configuration in which one medium after another is sequentially separated and fed from among a plurality of stacked media, a state called skew, in which a medium is sent in a skewed posture, occurs in some cases due to the effect of, such as, unevenness of pressure load between rollers that send out a medium, or partial contact.

As a technology for correcting skew, for example, Japanese Patent Application Laid-open No. 2005-187113 describes a technology in which when occurrence of skew is detected on the basis of a plurality of pieces of sensor information, a medium is pressed against a feeding roller to correct the skew. Moreover, Japanese Patent Application Laid-open No. 11-189355 describes a technology for correcting skew by preparing skewed rollers and driving them for pressing a medium against a reference guide in accordance with the detected amount of skew.

However, for example, the technology described in Japanese Patent Application Laid-open No. 2005-187113 requires dedicated control step for skew correction, such as a step of stopping a medium when pressing a medium against the guide, which may result in reduction of the processing speed and the productivity. Moreover, the technology described in Japanese Patent Application Laid-open No. 11-189355 has problems that the cost increases and the device becomes large in size and complicated due to provision of special members, such as a unit that detects the amount of skew and the skewed rollers for pressing a medium against the reference guide.

SUMMARY OF THE INVENTION

It is an object of the present invention to at least partially solve the problems in the conventional technology.

According to an aspect of the present invention, a medium feeding device comprises a feeding roller that conveys a medium in a conveying direction; a brake roller that includes a plurality of rollers that are arranged to be rotatable around one shaft and cause a conveyance load to act on the medium that has entered between the feeding roller and the brake roller, and is arranged to press the feeding roller with a predetermined pressure; and a rotational difference generating unit that generates a rotational difference between one roller and another roller so that the conveyance load acting on the medium by the one roller and the another roller becomes even when the rollers of the brake roller are divided into two in an axial direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinbelow, embodiments of a medium feeding device according to the present invention are described based on the drawings. In the following drawings, the same reference signs denote the same or equivalent portions, and the description thereof is not repeated.

First Embodiment

A first embodiment of the present invention is described with reference to FIGS. 1 to 6.

Figure 1:
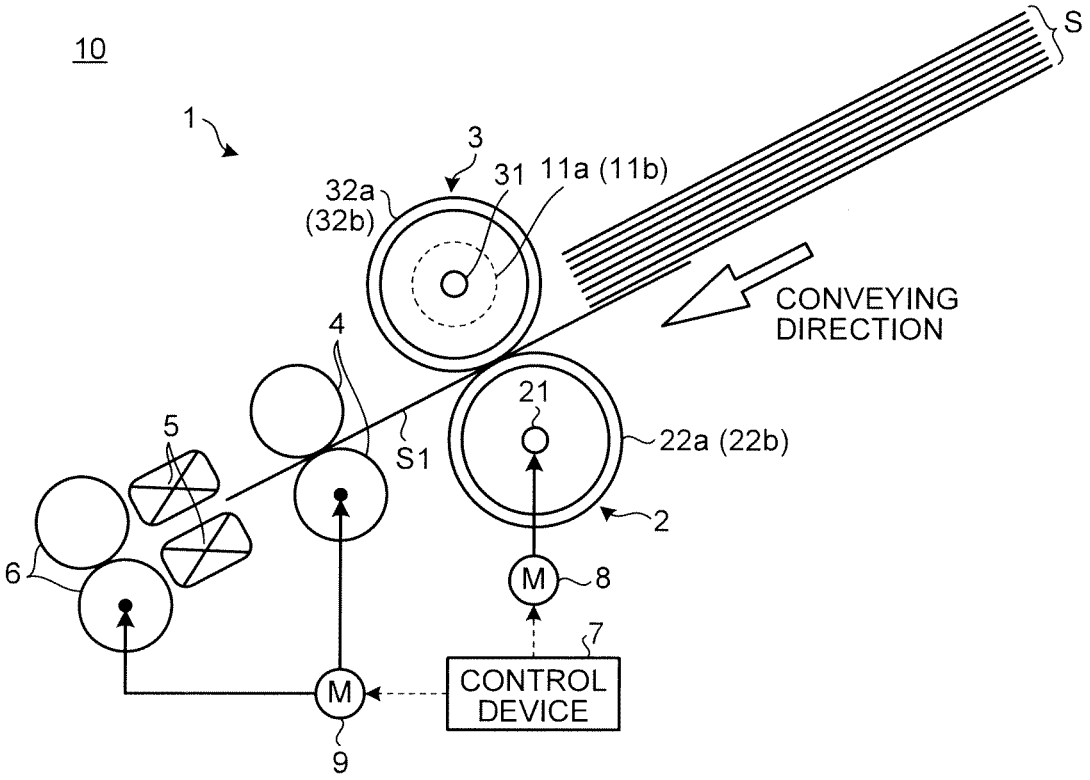
FIG. 1 is a cross-sectional view that illustrates a schematic configuration of an image reading apparatus on which a medium feeding device according to a first embodiment of the present invention is mounted.
Figure 2:
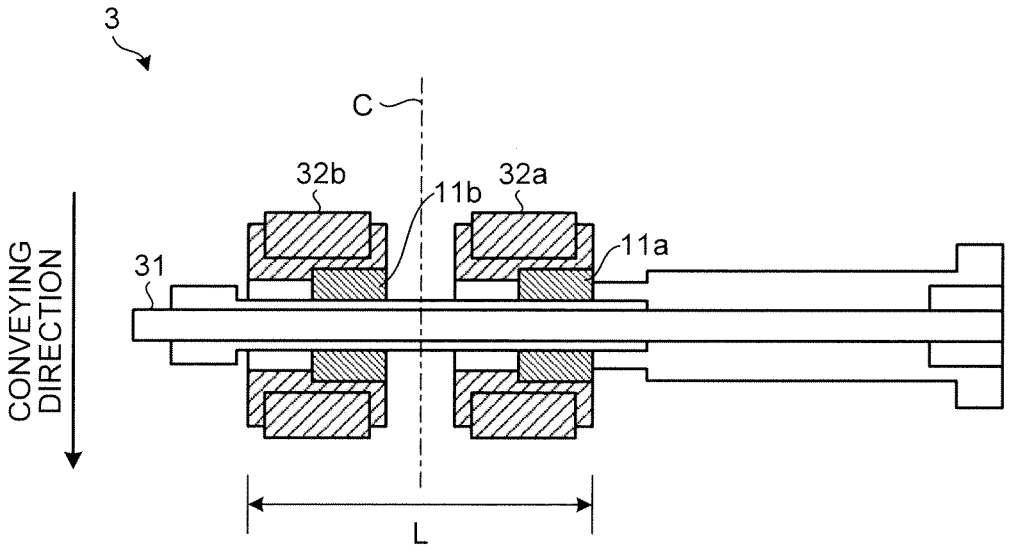
FIG. 2 is a plan view that illustrates a schematic configuration of a brake roller of the medium feeding device according to the first embodiment of the present invention.

Referring to FIGS. 1 and 2, the configuration of the medium feeding device according to the first embodiment of the present invention is described first. FIG. 1 is a cross-sectional view that illustrates a schematic configuration of an image reading apparatus on which the medium feeding device according to the first embodiment of the present invention is mounted and FIG. 2 is a plan view that illustrates a schematic configuration of a brake roller of the medium feeding device according to the first embodiment of the present invention.

As illustrated in FIG. 1, a medium feeding device 1 according to the present embodiment is a device which separates one medium after another from a plurality of stacked sheet-like media S and feeds it. The medium feeding device 1 is applied to an automatic paper feeder (Auto Document Feeder: ADF) mounted on image reading apparatuses, such as an image scanner, a copying machine, a facsimile, and a character recognition device, image forming apparatuses, such as a printer, or the like. In the present embodiment, a case in which the medium feeding device 1 is mounted on an image reading apparatus 10 and separates and conveys the sheet-like media S is explained as an example. Examples of the sheet-like media S, hereinafter media S, include sheet-like reading objects/print sheets, such as a manuscript and a business card, and sheet-like recording media, such as sheets of paper, for example.

The medium feeding device 1 can feed media of various sizes and employs a central-reference-position paper-feeding system in which media of various sizes are fed with the central position of the media in the width direction orthogonal to the conveying direction as a reference position. As illustrated in FIG. 1, the medium feeding device 1 includes a feeding roller 2, a brake roller 3, and a conveying roller 4 on a conveyance path along which media are conveyed in the conveying direction, and further includes a control device 7.

The media S are stacked on a not-shown hopper and the feeding roller 2 is a roller for feeding the lowermost one sheet of medium S1, which is a conveyance target, among the media S in the conveying direction. The feeding roller 2 includes a feeding shaft 21 arranged substantially orthogonal to the conveying direction and two rollers 22*a* and 22*b* provided around the feeding shaft 21. The feeding shaft 21 is arranged below the conveyance path of media and is driven to rotate along with the operation of a motor 8 controlled by the control device 7.

The rollers 22*a* and 22*b* of the feeding roller 2 are arranged in a direction substantially orthogonal to the conveying direction with a center line C along which the medium is conveyed, hereinafter medium-conveying center line C, therebetween (see FIG. 10). The rollers 22*a* and 22*b* are each, for example, formed in a cylindrical shape in which an inner layer thereof is made of a soft material, such as, rubber foam so that a nip width may be easily formed and the circumferential surfaces thereof can come into contact with one medium S1 present closest to the feeding roller 2 side among the stacked media S. In other words, the rollers 22*a* and 22*b* can convey the medium S1 as the conveyance target, which is in contact with the circumferential surfaces of the rollers 22*a* and 22*b*, in the conveying direction by rotating due to the driving force transmitted to the feeding shaft 21 from a single driving unit, i.e., the motor 8.

The brake roller 3 is a roller for preventing media other than the medium S1 of one sheet serving as the conveyance target, among the media S stacked on the not-shown hopper, from being fed in the conveying direction. The brake roller 3 is provided so as to face the feeding roller 2, and is in pressure-contact with the feeding roller 2. In this embodiment, "pressure-contact" means the state of pressing with arbitrary contact pressure. The arbitrary pressure is a predetermined pressure or a predetermined range of pressure to form a nip between the brake roller 3 and the feeding roller 2. Accordingly, the brake roller 3 is arranged to press the feeding roller 2 with a predetermined pressure;

As illustrated in FIGS. 1 and 2, the brake roller 3 includes a shaft 31 arranged substantially orthogonal to the conveying direction and two rollers 32*a* and 32*b* provided around the shaft 31. The rollers 32*a* and 32*b* are arranged in a direction substantially orthogonal to the conveying direction with the medium-conveying center line C therebetween. The rollers 32*a* and 32*b* are each, for example, formed in a cylindrical shape in which an inner layer thereof is made of a soft material, such as, rubber foam so that a nip width may be easily formed.

The rollers 32*a* and 32*b* of the brake roller 3 are in pressure-contact with the rollers 22*a* and 22*b* of the feeding roller 2. Consequently, a nip which is the contact surfaces of both of the rollers is formed between the roller 32*a* of the brake roller 3 and the roller 22*a* of the feeding roller 2 and between the roller 32*b* of the brake roller 3 and the roller 22*b* of the feeding roller 2. The medium S passes through the nip between the feeding roller 2 and the brake roller 3 and is fed to the downstream side in the conveying direction. The nip width N (see FIG. 4) which is the length of the nip in the conveying direction is adjustable according to the degree of the pressure-contact of the brake roller 3 against the feeding roller 2.

The brake roller 3 is configured such that when the torque equal to or larger than a predetermined torque of driven rotation is received, the brake roller 3 is able rotate along with the rotation of the feeding roller 2, and, when the torque smaller than the torque of driven rotation is received, the brake roller 3 generates a predetermined rotational load. Specifically, such a configuration can be realized by applying an FRR (Feed & Reverse Roller) Paper Feed System in which the shaft 31 is a driving shaft and a load is generated by rotating the shaft 31 in a direction counter to the conveying direction or a simple FRR system in which the shaft 31 does not reversely rotate.

When only a medium of one sheet has entered the nip, the brake roller 3 receives the torque equal to or larger than the torque of driven rotation and rotates along with the rotation of the feeding roller 2. On the other hand, when two or more sheets of the media have entered the nip, that is, when another medium also enters the nip together with the medium S1 serving as the conveyance target on the feeding roller 2 side, since the friction coefficient of the nip becomes relatively small, the brake roller 3 generates the rotational load, separates the medium, which is other than the medium S1 and enters the nip, by relatively moving the medium with respect to the medium S1 as the conveyance target. Consequently, the brake roller 3 allows only the medium S1 as the conveyance target to be sent out from the nip, and holds another medium in the nip, whereby the medium which is not the medium S1 of one sheet serving as the conveyance target is prevented from being fed in the conveying direction.

Moreover, as illustrated in FIG. 2, the brake roller 3 is provided such that an overall width L (roller outer size) in the direction of the shaft 31 is smaller than the width of a minimum set size of the medium S. Accordingly, the brake roller 3 is configured such that media S of all sizes used in the medium feeding device 1 can come into contact with both of the rollers 32*a* and 32*b* of the brake roller 3.

Specially, in the present embodiment, torque limiters 11*a* and 11*b* (hereinafter, two torque limiters 11*a* and 11*b* are collectively described as "torque limiter 11" in some cases) are connected to the rollers 32*a* and 32*b*, respectively, as a rotational difference generating unit that generates a difference (hereinafter, described as "rotational difference") in the number of rotations between the rollers 32*a* and 32*b* so that the conveyance load acting on a medium by the rollers 32*a* and 32*b* of the brake roller 3 becomes even. In other words, each of the rollers 32*a* and 32*b* of the brake roller 3 can be independently controlled whether to rotate along with the rotation of the feeding roller 2 or generate the rotational load in accordance with the torque received by each of the rollers 32*a* and 32*b*.

The conveying roller 4 is arranged downstream of the feeding roller 2 in the conveying direction, and further conveys downstream the medium S1 which has passed the feeding roller 2 in the conveying direction. The conveying roller 4 includes a driving roller driven by a motor 9 to rotate, and a driven roller which rotates along with the rotation of the driving roller by being in pressure-contact with the driving roller. The medium S1 passes between the driving roller and the driven roller so as to be conveyed downstream in the conveying direction.

An image reading unit 5 of the image reading apparatus 10 is arranged downstream of the conveying roller 4. When the medium S1 is conveyed to the reading position of the image reading unit 5 by the conveying roller 4, the image reading unit 5 generates image data on the medium by performing read scanning on the medium S1.

Moreover, a discharging roller 6 is arranged downstream of the image reading unit 5. The discharging roller 6 discharges downstream the medium on which the read scanning is performed by the image reading unit 5. The discharging roller 6 includes a driving roller driven by the motor 9 to rotate, and a driven roller which rotates along with the rotation of the driving roller by being in pressure-contact with the driving roller. That means that the conveying roller 4 and the discharging roller 6 are configured to be rotatable by the common motor 9.

The control device 7 controls every unit of the medium feeding device 1 and the image reading apparatus 10. As illustrated in FIG. 1, the control device 7 is connected to the motors 8 and 9, and thereby controls the rotation of the feeding roller 2 to which the motor 8 is connected and the rotation of the conveying roller 4 and the discharging roller 6 to which the motor 9 is connected. Moreover, although it is not shown in FIG. 1, the control device 7 is also connected to the image reading unit 5 and controls the image reading operation by the image reading unit 5.

Physically, the control device 7 is a computer which includes a CPU (Central Processing Unit), RAM (Random Access Memory), ROM (Read Only Memory), etc. All or a part of each function of the control device 7 described above is realized in a manner that application programs held in the ROM are loaded into the RAM and then executed by the CPU and, as a result, data is read out of and/or written in the RAM and/or ROM.

Figure 3:
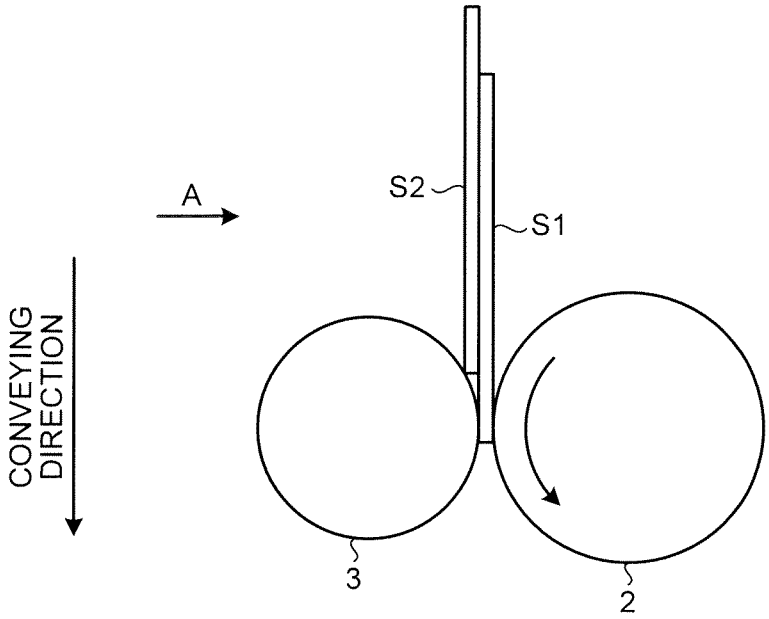
FIG. 3 is a cross-sectional view for explaining the positional relationship between components illustrated in the following plan views in FIGS. 4 to 6.
Figure 4:
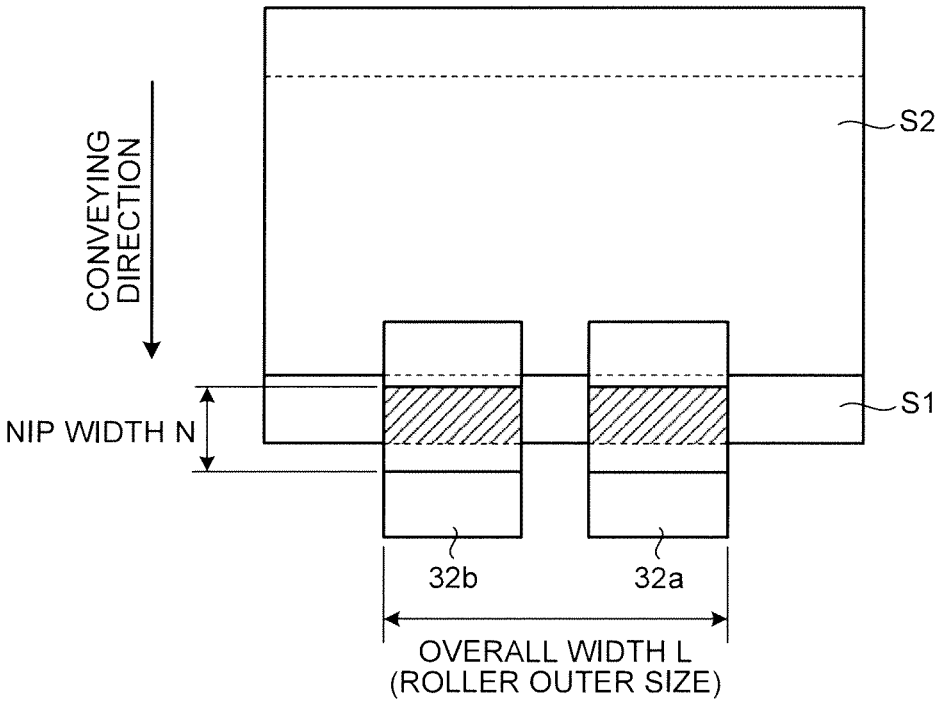
FIG. 4 is a plan view for explaining the reduction operation of skew by the medium feeding device according to the first embodiment of the present invention.
Figure 5:
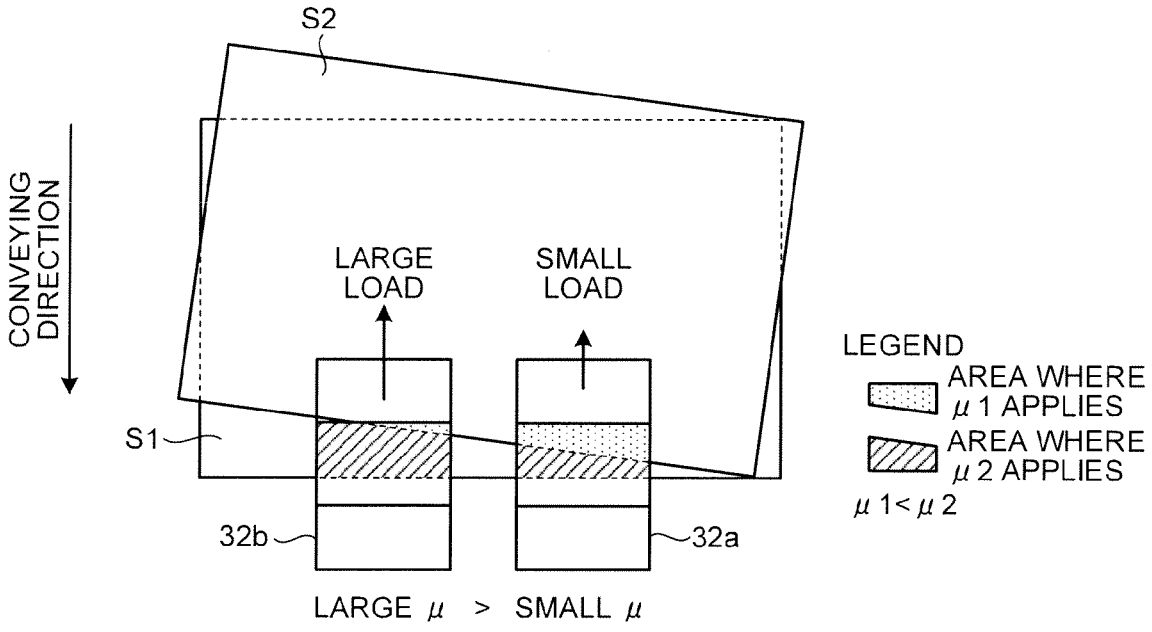
FIG. 5 is a plan view for explaining the reduction operation of skew by the medium feeding device according to the first embodiment of the present invention.
Figure 6:
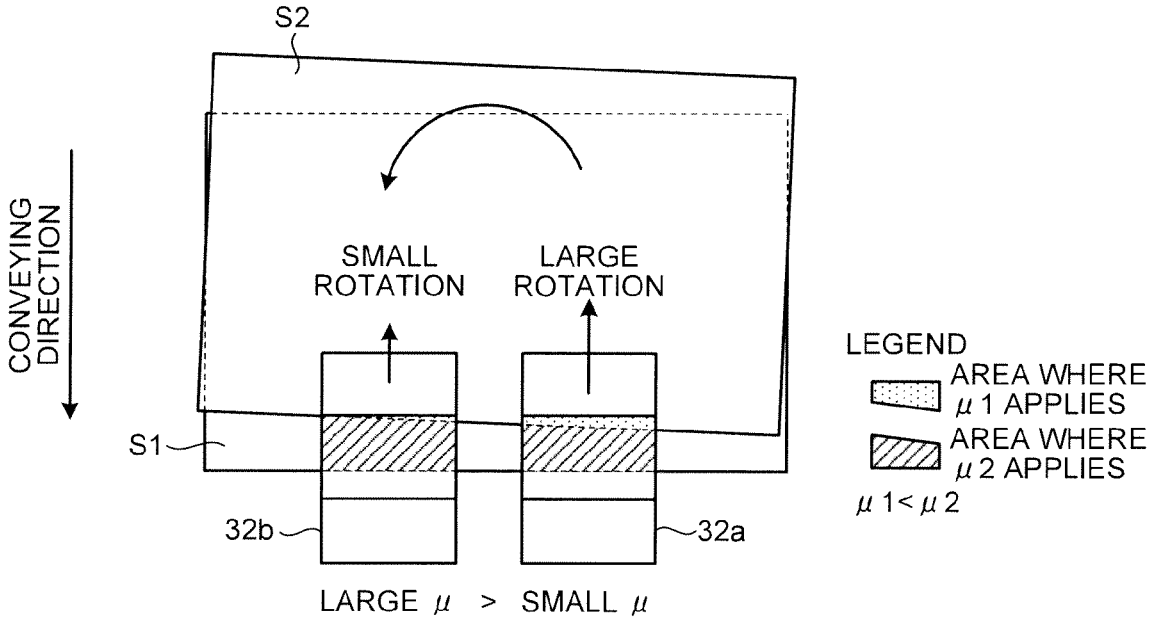
FIG. 6 is a plan view for explaining the reduction operation of skew by the medium feeding device according to the first embodiment of the present invention.

Next, referring to FIGS. 3 to 6, the operation of the medium feeding device according to the present embodiment is explained. FIG. 3 is a cross-sectional view for explaining the positional relationship between components illustrated in the following plan views in FIGS. 4 to 6 and FIGS. 4 to 6 are plan views for explaining the reduction operation of skew by the medium feeding device according to the first embodiment of the present invention.

FIG. 3 is an enlarged schematic diagram showing a portion around the brake roller 3 in the medium feeding device 1 in FIG. 1. FIG. 3 illustrates only the lowermost first medium S1, which is the conveyance target, and the second medium S2, which is stacked immediately above the medium S1 and is the conveyance target next to the medium S1, among the stacked media S. FIGS. 4 to 6 are diagrams viewing the schematic diagram in FIG. 3 in the direction of arrow A. In other words, in FIGS. 4 to 6, the brake roller 3, the medium S2, and the medium S1 are illustrated in this sequence from the nearest side in the depth direction in the drawings. In FIGS. 4 to 6, the illustration of feeding roller 2 is omitted. In FIGS. 3 to 6, the conveying direction of the medium S is downward and the medium S is conveyed downward from above.

As illustrated in FIG. 4, when the width direction of the medium S is substantially orthogonal to the conveying direction, only the medium S1 has entered the nip of the brake roller 3 and the medium S2 is located upstream thereof. In other words, the load by the two right and left rollers 32*a* and 32*b* of the brake roller 3 is evenly applied to the medium S1.

A case in which the second medium S2 on the hopper is obliquely set is considered. In this case, as illustrated in FIG. 5, part of the medium S2 on the side skewed in the advancing direction has entered the nip and is present between the brake roller 3 and the medium S1. At that time, areas in which each of the rollers 32*a* and 32*b* of the brake roller 3 can directly come into contact with the medium S1 are different from each other. Since a larger part of the medium S2 has entered the nip of the roller 32*a*, the contact area of the roller 32*a* and the medium S1 becomes relatively small.

The medium S1 is in contact with the circumferential surface of each of the rollers 32*a* and 32*b* of the brake roller 3 at a rate different from the medium S2. The circumferential surfaces of the rollers 32*a* and 32*b* are made of mainly a rubber material, whereas the material of the media S1 and S2 are mainly paper. Since the material of the circumferential surfaces of the rollers 32*a* and 32*b* and the material of the media S1 and S2 are different from each other, the friction coefficient $\mu 1$ between the medium S2 and the medium S1, that is, the friction coefficient between paper materials, is different from the friction coefficient $\mu 2$ between the rollers 32*a* and 32*b* and the medium S1, that is, the friction coefficient between a rubber material and a paper material. As shown in legends in FIGS. 5 and 6, an area with a pattern of dots indicates an area where the friction coefficient $\mu 1$ applies, and an area with a pattern of oblique lines indicates an area where the friction coefficient $\mu 2$ applies. Generally, the friction coefficients $\mu 1$ and $\mu 2$ satisfy relationship of $\mu 1 < \mu 2$.

When the exposed area of the brake roller 3 is large, the friction coefficient $\mu$ of the entire nip becomes large, consequently, the load that the medium S1 receives from the brake roller 3 becomes large. On the other hand, when the exposed area of the brake roller 3 is small, the friction coefficient $\mu$ of the entire nip becomes small, consequently, the load that the medium S1 receives from the brake roller 3 becomes small.

Thus, in this case, the loads that the medium S1 receives from the right and left rollers 32*a* and 32*b* of the brake roller 3 are unbalanced.

When this state is viewed from the side of the brake roller 3, in the roller 32*a* in which the medium S2 has entered the nip deeply, the contact area of the medium S1 and the medium S2 is large, therefore, the friction coefficient μ of the entire nip is small and the load viewed from the roller 32*a* becomes small. On the other hand, in the roller 32*b* in which the medium S2 has not entered the nip deeply, the contact area with the medium S1 is large, therefore, the friction coefficient μ of the entire nip is large and the load viewed from the roller 32*b* becomes large.

Since the two rollers 32*a* and 32*b* of the brake roller 3 include therein the torque limiters 11*a* and 11*b*, respectively, the amount of reversing (rotating) the roller in the direction counter to the conveying direction becomes different between the rollers 32*a* and 32*b* in accordance with the load that each of the rollers 32*a* and 32*b* receive. In the example illustrated in FIG. 6, the amount of rotation (amount of reverse) of the roller 32*b* that receives a large load become small and the amount of rotation (amount of reverse) of the roller 32*a* that receives a small load becomes large.

Consequently, the medium S2, which is obliquely set, is rotated in the direction that reduces skew as illustrated in FIG. 6, until the deviation of the loads that the rollers 32*a* and 32*b* respectively receive is eliminated and thereby the loads become substantially even, by the rotational difference between the right and left rollers 32*a* and 32*b* of the brake roller 3. As a result, the skewed condition of the medium S2 is reduced.

The medium feeding device 1 in the present embodiment includes the feeding roller 2 that conveys the medium S1 in the conveying direction and the brake roller 3 that includes the rollers 32*a* and 32*b* that are arranged to be able to rotate around the shaft 31. The rollers 32*a* and 32*b* are in pressure-contact with the feeding roller 2 and cause the conveyance load to act on the medium S2 that has entered the gap between the feeding roller 2 and the rollers 32*a* and 32*b*. Moreover, the medium feeding device 1 includes the torque limiters 11*a* and 11*b*, which are connected to the rollers 32*a* and 32*b*, respectively, as the rotational difference generating unit. The rotational difference generating unit generates a rotational difference between the rollers 32*a* and 32*b* so that the conveyance load acting on the medium S by the rollers 32*a* and 32*b* of the brake roller 3 becomes even.

With this configuration, when skew of the medium S occurs, the torques that the rollers 32*a* and 32*b* of the brake roller 3 receive differs from each other. Since the torque limiters 11*a* and 11*b* are connected to the rollers 32*a* and 32*b*, respectively, the rotational difference occurs between the rollers 32*a* and 32*b*, which reduces the skew of the medium S, as explained with reference to FIGS. 4 to 6. Moreover, just arranging the torque limiters 11*a* and 11*b* respectively for the rollers 32*a* and 32*b* of the brake roller 3, makes costly dedicated members and a control method unnecessary. Thus, the medium feeding device 1 in the present embodiment can reduce the skewed condition of the medium S at low cost and with a simple configuration.

Second Embodiment

Figure 7:
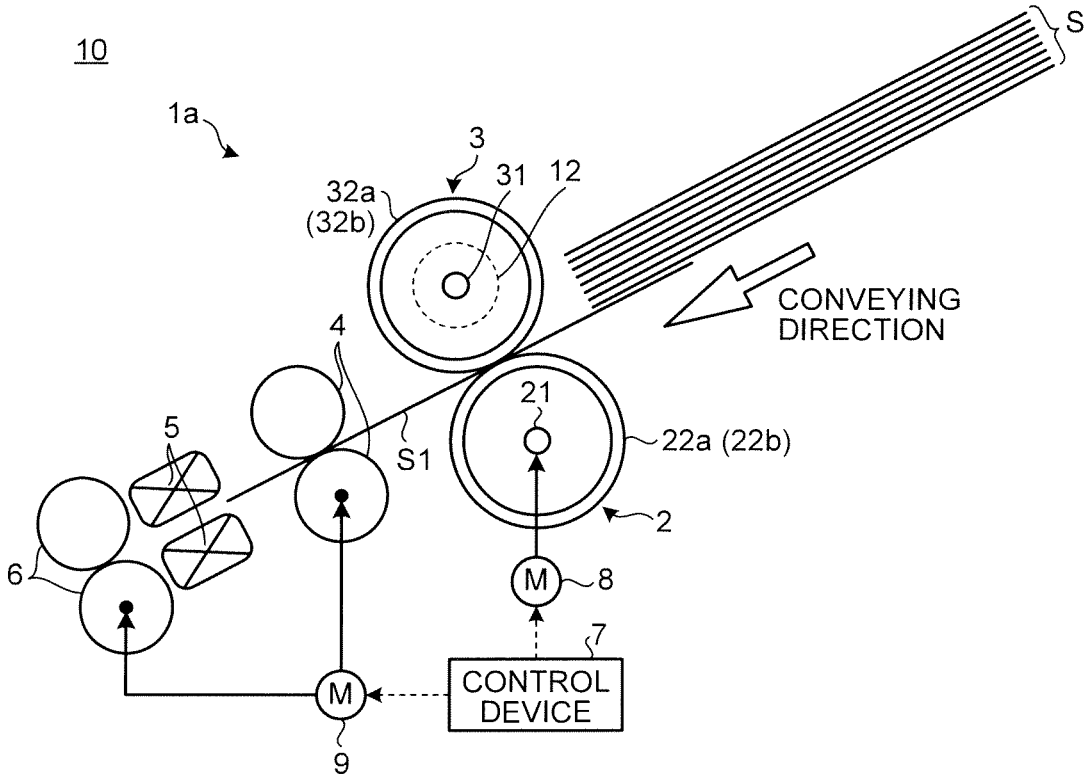
FIG. 7 is a cross-sectional view that illustrates a schematic configuration of an image reading apparatus on which a medium feeding device according to a second embodiment of the present invention is mounted.

Next, a second embodiment of the present invention is described with reference to FIGS. 7 and 8. FIG. 7 is a cross-sectional view that illustrates a schematic configuration of an image reading apparatus on which a medium feeding device according to the second embodiment of the present invention is mounted and FIG. 8 is a plan view that illustrates a schematic configuration of a brake roller of the medium feeding device according to the second embodiment of the present invention.

Figure 8:
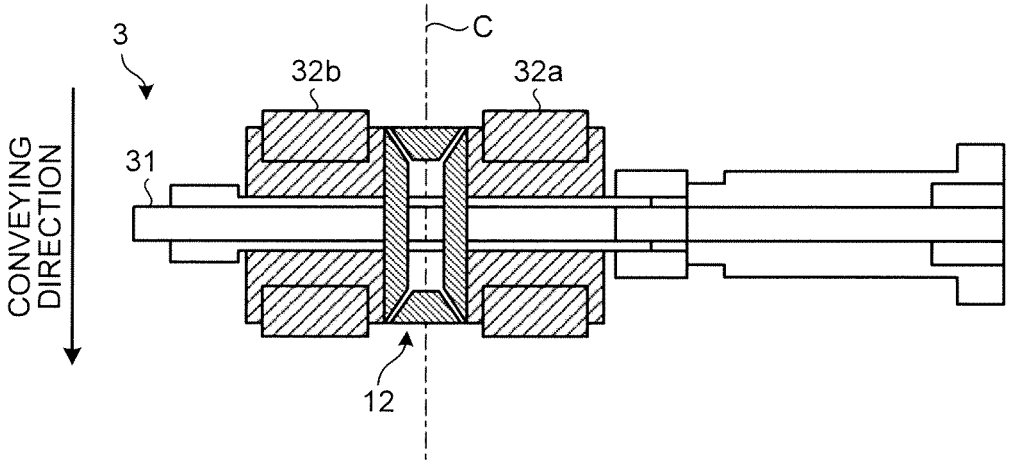
FIG. 8 is a plan view that illustrates a schematic configuration of a brake roller of the medium feeding device according to the second embodiment of the present invention.

As illustrated in FIGS. 7 and 8, a medium feeding device 1*a* according to the present embodiment is different from the medium feeding device 1 in the first embodiment in that it includes a differential gear 12 between the rollers 32*a* and 32*b* of the brake roller 3.

The differential gear 12 is composed of, for example, two pairs of bevel gears. When there is a difference between the torques that the rollers 32*a* and 32*b* receive, the differential gear 12 equalizes the loads by providing a difference in the number of rotations between the rollers 32*a* and 32*b*. In other words, in a similar manner to the torque limiters 11*a* and 11*b* in the first embodiment, the differential gear 12 can also generate a rotational difference between the rollers 32*a* and 32*b* so that the conveyance load acting on the medium S becomes even.

Therefore, the medium feeding device 1*a* in the present embodiment can perform an operation similar to the medium feeding device 1 in the first embodiment explained with reference to FIGS. 4 to 6, therefore, an operation effect similar to the first embodiment can be obtained.

Third Embodiment

Next, a third embodiment of the present invention is described with reference to FIGS. 9 to 14.

Figure 9:
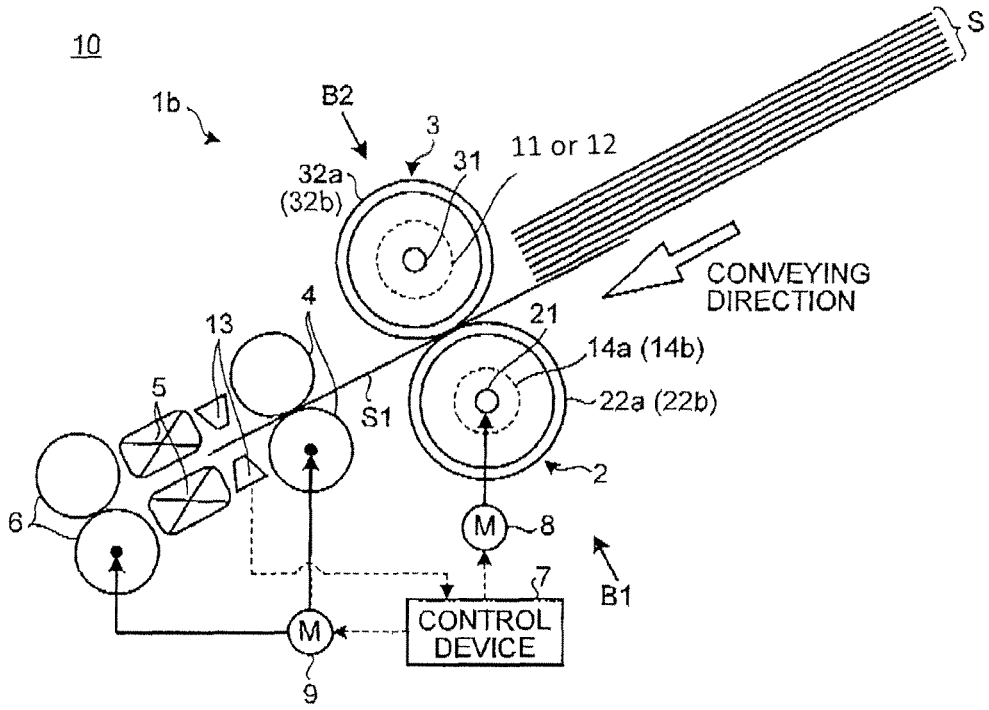
FIG. 9 is a cross-sectional view that illustrates a schematic configuration of an image reading apparatus on which a medium feeding device according to a third embodiment of the present invention is mounted.
Figure 10:
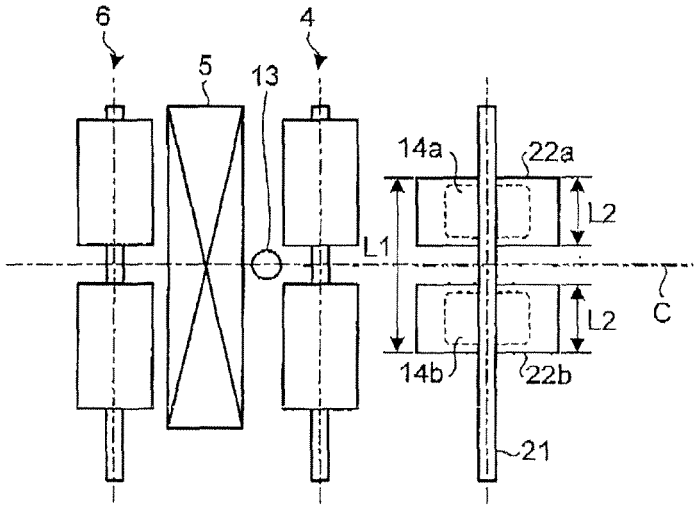
FIG. 10 is a plan view that illustrates a schematic configuration of the medium feeding device according to the third embodiment of the present invention when viewed in the direction of arrow B1 shown in FIG. 9.

Referring to FIGS. 9 and 10, the configuration of the medium feeding device according to the third embodiment of the present invention is described. FIG. 9 is a cross-sectional view that illustrates a schematic configuration of an image reading apparatus on which a medium feeding device according to the third embodiment of the present invention is mounted and FIG. 10 is a plan view that illustrates a schematic configuration of the medium feeding device according to the third embodiment of the present invention when viewed in the direction of arrow B1 shown in FIG. 9.

As illustrated in FIGS. 9 and 10, a medium feeding device 1*b* of the present embodiment is different from the above embodiments in that (1) it includes one-way clutches 14*a* and 14*b* in the rollers 22*a* and 22*b* of the feeding roller 2 and (2) it includes a medium sensor 13, which detects a medium, downstream of the conveying roller 4, and the control device 7 stops the rotation of the feeding roller 2 in accordance with the detection by the medium sensor 13.

As illustrated in FIG. 10, the feeding roller 2 is provided such that an overall width L1 in the direction of the feeding shaft 21 is smaller than the width of a minimum set size of the medium S and is configured such that media S of all sizes used in the medium feeding device 1*b* can come into contact with both of the rollers 22*a* and 22*b* of the feeding roller 2.

Moreover, when the overall width of the feeding roller 2 in the direction of the feeding shaft 21 is L1, width of the rollers 22*a* and 22*b* is L2 and L2, respectively, as illustrated in FIG. 10, and n is the number of rollers of the feeding roller 2 (in the present embodiment, n=2), the feeding roller 2 is provided to satisfy the following condition:

$$n \cdot L2/L1 \leq 0.95$$

Consequently, the feeding roller 2 is configured to have a gap between the two rollers 22*a* and 22*b* of the feeding roller 2. Consequently, the internal surfaces of the rollers 22*a* and 22*b* can be prevented from coming into contact with each other, which allows each of the rollers 22*a* and 22*b* to rotate respectively. Namely, the rotation operation of each of the rollers 22*a* and 22*b* can be prevented from being obstructed by the rollers 22*a* and 22*b* coming into contact with each other.

As illustrated in FIGS. 9 and 10, the one-way clutches 14*a* and 14*b* (rotation restricting unit) are provided between the roller 22*a* and the feeding shaft 21, and between the roller 22*b* and the feeding shaft 21, respectively. The one-way clutches 14*a* and 14*b* are arranged to allow the rollers 22*a* and 22*b* to rotate in a conveying rotation direction in which the medium S1 which is the conveyance target is conveyed. The one-way clutches 14*a* and 14*b* also restrict the rollers 22*a* and 22*b* to rotate in the direction counter to the conveying rotation direction.

In other words, the rollers 22*a* and 22*b* of the feeding roller 2 are configured to integrally rotate by the driving force transferred to the feeding shaft 21 from the motor 8 that is a single driving unit. The rollers 22*a* and 22*b* are also configured to individually perform the rotation or stop operation by the one-way clutches 14*a* and 14*b* provided thereto, respectively.

As a specific configuration of the one-way clutches 14*a* and 14*b*, for example, a configuration, such as a roller type, a cam type, a coil spring type, a ratchet type, and a sprag type, can be applied. Moreover, support members, such as a sintered bearing, a resin bearing, and a ball bearing, may be arranged on both sides of the one-way clutches 14*a* and 14*b* in the axial direction and the support members may support the radial load applied to the one-way clutches 14*a* and 14*b*.

The feeding roller 2 is typically consumable and is appropriately replaced in accordance with its usage. As replacement units of the feeding roller 2, at least following four types are exemplified:

(1) a driving gear and shaft integrated type including the feeding shaft 21, the rollers 22*a* and 22*b*, and a gear that connects the feeding shaft 21 and the motor 8, (2) a roller integrated type in which the integrally formed rollers 22*a* and 22*b* with the one-way clutches 14*a* and 14*b* included therein can be separated from the feeding shaft 21, (3) one roller type (one-way clutch is included) in which each of the rollers 22*a* and 22*b* can be separated from the feeding shaft 21 together with respective one of the one-way clutches 14*a* and 14*b* included therein, and (4) one roller type (one-way clutch is not included) in which each of the rollers 22*a* and 22*b* can be separated from the one-way clutches 14*a* and 14*b*.

As illustrated in FIG. 9, the medium sensor 13 is arranged on a conveyance path of the medium S1 and detects the passage of the tip of the medium S1. The medium sensor 13 is arranged immediately after the conveying roller 4 in the conveying direction. In the present embodiment, the medium sensor 13 comprises a pair of sensors arranged such that the sensors face each other along the thickness direction of the medium S1 with the conveyance path of the medium S1 therebetween. The medium sensor 13 detects the passage of the medium S1 between the facing sensors. The medium sensor 13 may be arranged at any position, for example, upstream of the conveying roller 4 as long as the medium sensor 13 can detect the entry of the medium S into the conveying roller 4.

When the medium sensor 13 detects the passage of the tip of the medium S1, the control device 7 determines that the medium S1 has reached the conveying roller 4 and performs control of stopping the operation of the motor 8 to stop the rotation of the feeding roller 2. Moreover, the control device 7 stores image data on the medium S1 read by the image reading unit 5. Furthermore, the control device 7 (correcting unit) may be configured to perform image processing of correcting skew of the image of the medium S1 read by the image reading unit 5.

Figure 11:
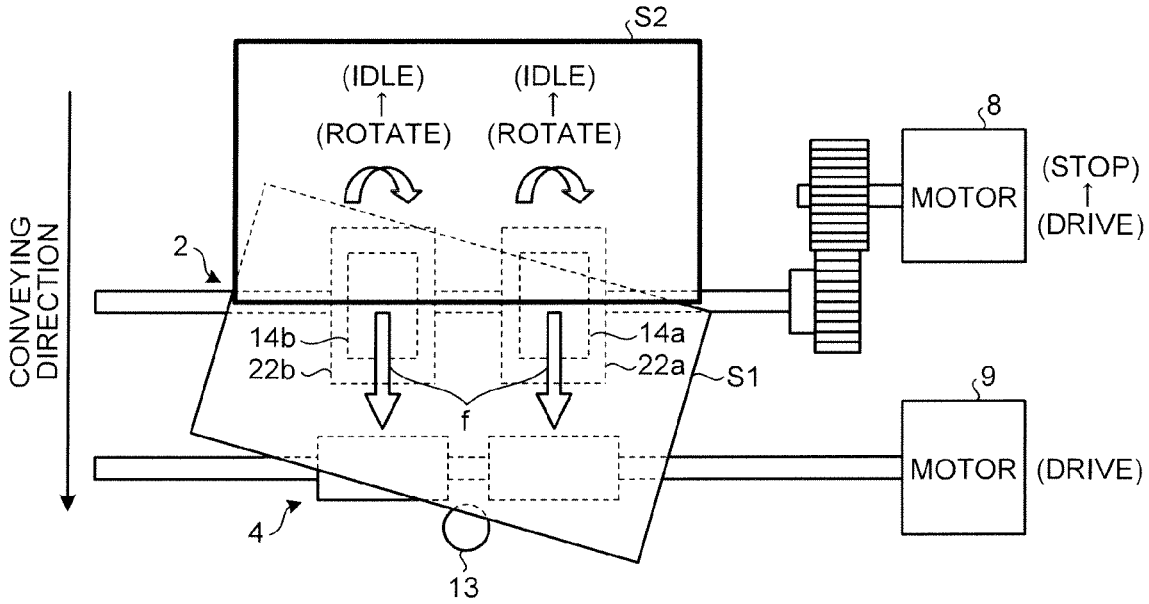
FIG. 11 is a plan view for explaining the suppression operation of skew chain by the medium feeding device according to the third embodiment of the present invention.
Figure 12:
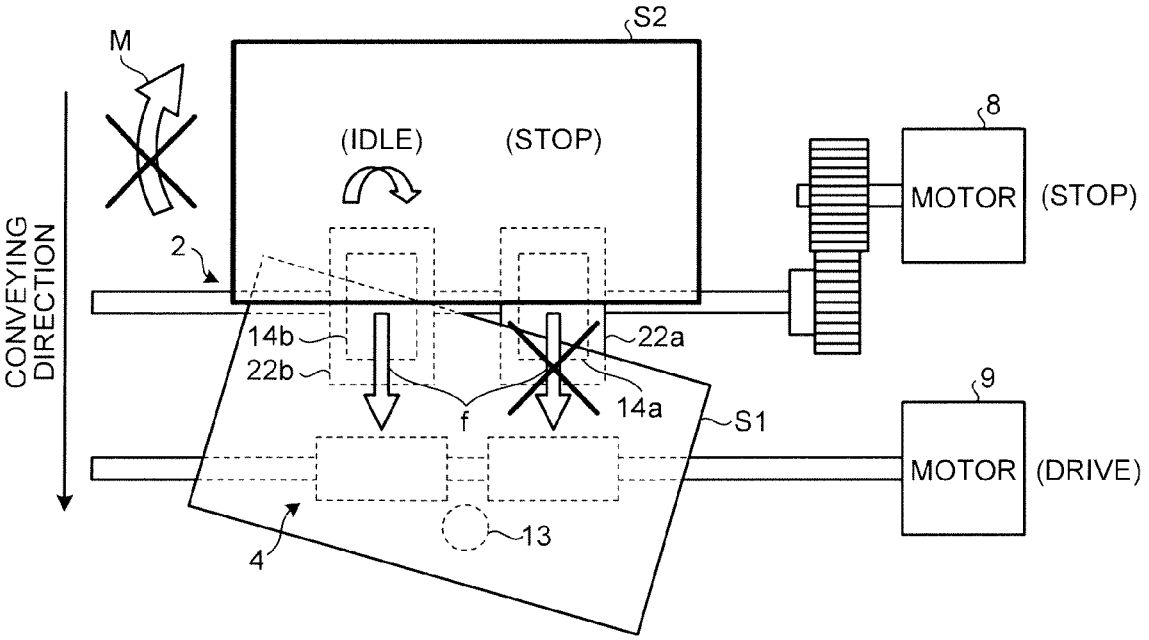
FIG. 12 is a plan view for explaining the suppression operation of skew chain by the medium feeding device according to the third embodiment of the present invention.
Figure 13:
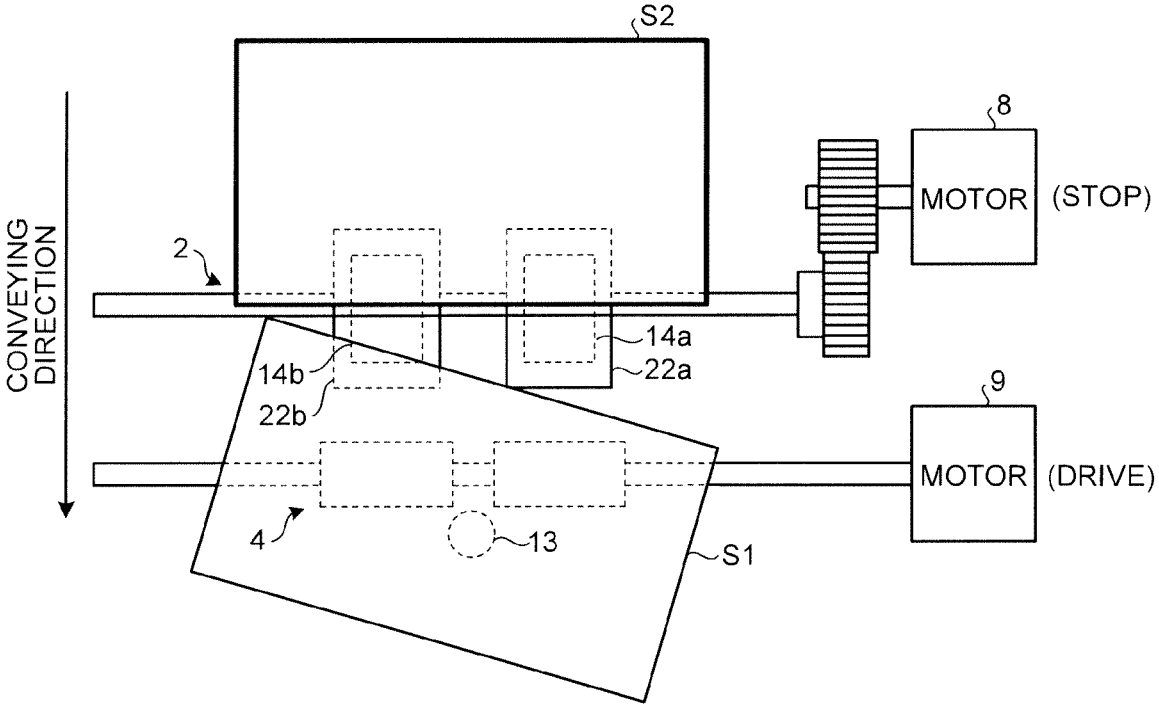
FIG. 13 is a plan view for explaining the suppression operation of skew chain by the medium feeding device according to the third embodiment of the present invention.

Next, referring to FIGS. 11 to 13, the operation of the medium feeding device according to the present embodiment is explained. FIGS. 11 to 13 are plan views for explaining the suppression operation of skew chain by the medium feeding device according to the third embodiment of the present invention.

FIGS. 11 to 13 illustrate diagrams viewing the feeding roller 2 and the conveying roller 4 in FIG. 9 from the brake roller 3 side (direction of arrow B2 illustrated in FIG. 9). In FIGS. 11 to 13, the conveying direction of the medium S is downward and the medium S is conveyed downward from above. Moreover, among the stacked media S, only the lowermost first medium S1, which is the conveyance target, and the second medium S2, which is stacked immediately above the medium S1 and is the conveyance target next to the medium S1, are illustrated. In other words, in FIGS. 11 to 13, the medium S2, the medium S1, and the feeding roller 2 and the conveying roller 4 are hierarchically illustrated in this sequence from the nearest side in the depth direction in the drawings.

In the initial state of the operation illustrated in FIGS. 11 to 13, the feeding roller 2 is driven to rotate in the direction that sends out the medium S1 in the conveying direction by the motor 8 and the rollers 22*a* and 22*b* are also rotationally driven. The conveying roller 4, which is arranged downstream side in the conveying direction with respect to the feeding roller 2, is also driven to rotate by the motor 9 in the rotational direction in which the medium S1 is sent out in the conveying direction. In this case, a situation is considered in which the state, where the medium S1, or the conveyance target, is conveyed in a skewed posture called skew as illustrated in FIG. 11, occurs due to the effect of uneven pressure load between rollers, partial contact, or the like, and where the medium S1 is inserted into the feeding roller 2 keeping the skewed posture.

When the medium S1 is inserted into the feeding roller 2, the circumferential surfaces of the two rollers 22*a* and 22*b* directly come into contact with the inserted medium S1. As illustrated in FIG. 11, when the feeding roller 2 that is in contact with the medium S1 is rotationally driven, the medium S1 receives a frictional force in the conveying direction from the circumferential surfaces of the rollers 22*a* and 22*b* and is sent out to the downstream side in the conveying direction by the frictional force. At this time, the second medium S2 staked on the medium S1 is not in contact with the feeding roller 2 because the medium S1 is present between the medium S2 and the feeding roller 2, therefore, the force in the conveying direction is not transmitted to the medium S2.

When the medium sensor 13 detects the passage of the medium S1, the control device 7 determines that the medium S1 has reached the conveying roller 4 and stops the motor 8. Consequently, the rotation of the feeding roller 2 is stopped. At this time, the medium S1 is sent out to the downstream side in the conveying direction by the rotation of the conveying roller 4.

The circumferential surfaces of the rollers 22*a* and 22*b* of the feeding roller 2 receive a frictional force f in the conveying direction by the movement of the medium S1 in the conveying direction. This frictional force f acts in the same direction as the direction of the frictional force that the medium S1 receives from the rollers 22*a* and 22*b* by the rotation of the motor 8. The one-way clutches 14*a* and 14*b* arranged between the rollers 22*a* and 22*b* and the feeding shaft 21 can be rotated by the frictional force f. Therefore, both of the rollers 22*a* and 22*b* are idled by the frictional force f and rotate along with the rotation of the conveying roller 4, whereby the medium S1 is sent out in the conveying direction.

When delivery of the medium S1 by the conveying roller 4 proceeds, the medium S1 separates from the feeding roller 2 and the second medium S2 is transitioned to the state of being in contact with the feeding roller 2. As described above, since skew of the medium S1 occurs, in the process of sending out such a medium S1 to the conveying roller 4 side, as illustrated in FIG. 12, the state occurs in which one roller 22*a* first separates from the medium S1 and the other roller 22*b* is in contact with the medium S1. In other words, the medium S1 has passed through the nip of one roller 22*a* and is in the nip of the other roller 22*b*.

In this case, since the roller 22*a* through which the medium S1 has first passed does not receive the frictional force f in the conveying direction from the medium S1, the roller 22*a* does not rotate along with the rotation of the conveying roller 4 and stops the rotation. Therefore, although the roller 22*a* is in contact with the medium S2 to be fed next before the roller 22*b*, the roller 22*a* does not draw the medium S2 to the inside. Furthermore, since the one-way clutch 14*a* restricts the rotation in the direction counter to the conveying direction, even if the medium S2 receives the rotational load from the brake roller 3, the roller 22*a* does not rotate in the counter direction by this rotational load. Therefore, the behavior where the medium S2 is returned in the direction counter to the conveying direction does not occur.

On the other hand, since the roller 22*b* that is in contact with the medium S1 receives the frictional force f in the conveying direction by the medium S1, the roller 22*b* is idled by the frictional force f and keeps rotating along with the rotation of the conveying roller 4. Since the medium S1 is still present between the medium S2 and the roller 22*b*, the medium S2 is not in contact with the roller 22*b* and the frictional force f in the conveying direction is not transmitted to the medium S2. In other words, although the contact state of the medium S2 and the roller is different for each of the rollers 22*a* and 22*b*, the medium S2 does not receive a rotation moment M in a skew angle direction.

Then, as illustrated in FIG. 13, after the medium S1 passes through the nip of both of the rollers 22*a* and 22*b*, the medium S2 is inserted into both of the rollers 22*a* and 22*b* substantially at the same time while maintaining the posture in which the width direction thereof is substantially orthogonal to the conveying direction. Thus, the skew of the medium S1 is prevented from being transferred to the medium S2.

Next, an effect of the medium feeding device 1*b* according to the present embodiment is explained.

The medium feeding device 1*b* in the present embodiment includes the feeding roller 2 that includes two rollers 22*a* and 22*b* that rotate by the driving force from a single driving unit (the motor 8) transmitted to one feeding shaft 21 and convey the medium S1 in the conveying direction, the brake roller 3 that causes a predetermined conveyance load to act on the medium S2 that has entered between the feeding roller 2 and the brake roller 3 by being in pressure-contact with the feeding roller 2, the conveying roller 4 that is arranged downstream of the feeding roller 2 in the conveying direction, and the medium sensor 13 that is arranged downstream of the feeding roller 2 in the conveying direction and detects the medium S1. In the medium feeding device 1*b*, the one-way clutches 14*a* and 14*b* are arranged between the rollers 22*a* and 22*b* of the feeding roller 2, respectively, and the feeding shaft 21, which allow the rollers 22*a* and 22*b* to rotate in the conveying rotation direction that conveys the medium S1 in the conveying direction and restrict the rollers 22*a* and 22*b* to rotate in the direction counter to the conveying rotation direction. Moreover, when the medium sensor 13 detects the entry of the medium S1 into the conveying roller 4, the medium feeding device 1*b* performs control of stopping the rotation of the feeding shaft 21 by the motor 8.

With this configuration, since the one-way clutches 14*a* and 14*b* are arranged in the rollers 22*a* and 22*b*, respectively, the right and left rollers 22*a* and 22*b* can perform different behaviors in accordance with the contact state of each of the rollers 22*a* and 22*b* and the medium S1. More specifically, it is possible for each of the rollers 22*a* and 22*b* to individually perform the operation of rotating a roller along with the rotation of the conveying roller 4 while the roller is in contact with the medium S1, and the operation of stopping the rotation of a roller when the roller is not in contact with the medium S1. Consequently, even when skew occurs in the medium S1 that has entered the conveying roller 4 from the feeding roller 2, the rotation of the feeding shaft 21 by the motor 8 is controlled to stop in response to the entry of the medium S1 into the conveying roller 4. Therefore, as explained with reference to FIGS. 11 to 13, the right and left rollers 22*a* and 22*b* perform different behaviors in accordance with the contact state of the rollers 22*a* and 22*b* and the medium S1. Thus, skew can be suppressed from being transferred to the medium S2 to be fed next and thus skew chain can be suppressed.

Moreover, the one-way clutches 14*a* and 14*b* are provided for the rollers 22*a* and 22*b*, respectively, therefore, the feeding roller 2 can cause the rollers 22*a* and 22*b* to operate separately by using only the single driving unit (the motor 8) as in the conventional technology without specially preparing driving units for each of the rollers 22*a* and 22*b*. As a result, chain of skewed conditions of the medium S can be suppressed with a simple configuration.

Figure 14:
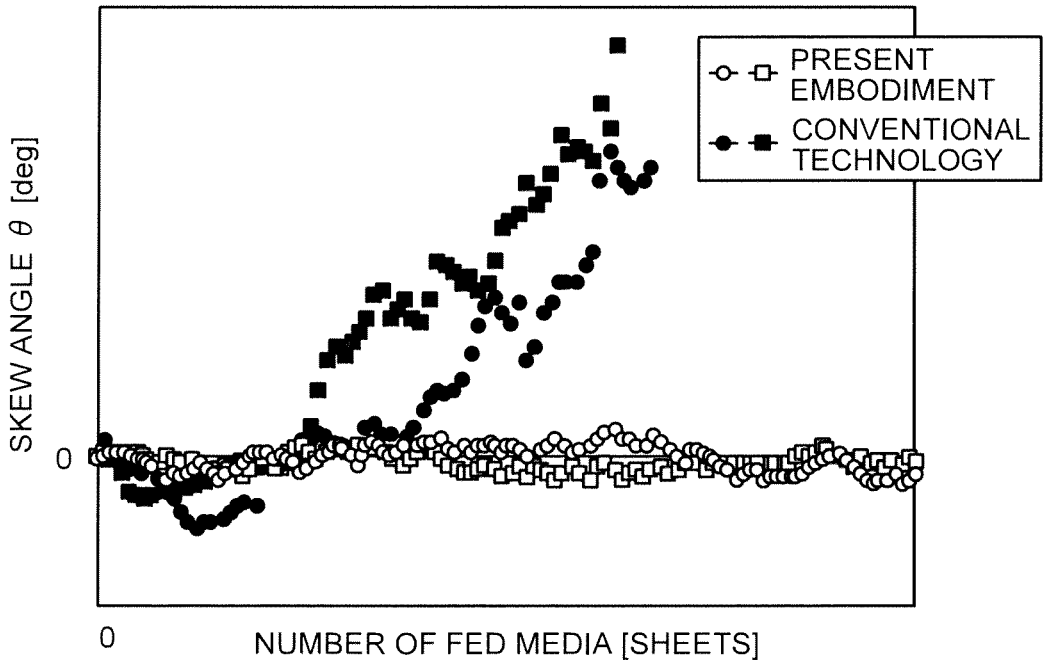
FIG. 14 is a graph for explaining a suppression effect of skew chain according to the third embodiment of the present invention.

A suppression effect of skew chain by the medium feeding device 1*b* in the present embodiment is explained with reference to FIG. 14. FIG. 14 is a graph for explaining a suppression effect of skew chain according to the third embodiment of the present invention.

FIG. 14 is obtained by plotting a skew angle for each number of supplied media when the medium S of A6 size is set sideways (skew angle is 0°) with respect to the conveying direction and is supplied without using a side guide in the medium feeding device 1*b* in the present embodiment. Moreover, the experimental results in the conventional technology in which one common one-way clutch is provided for the rollers 22*a* and 22*b* of the feeding roller 2 are plotted for comparison.

In FIG. 14, the horizontal axis indicates the number of supplied media S [sheets] and the vertical axis indicates the skew angle θ [deg]. Moreover, white plots represent the experimental results in the present embodiment and black plots represent the experimental results in the conventional technology.

As illustrated in FIG. 14, in the conventional technology, skew tends to become remarkable and gradually degrade as the number of supplied media increases. On the contrary, in the medium feeding device 1*b* in the present embodiment, even if the number of supplied media increases, the skew angle θ is stable near 0 degrees. In this manner, FIG. 14 indicates that degradation of skew can be suppressed by the present embodiment.

Moreover, in the medium feeding device 1*b* of the present embodiment, the overall width L1 of the feeding roller 2 in the direction of the feeding shaft 21 is smaller than the width of a minimum set size of the medium S.

Consequently, the media S of all sizes used in the medium feeding device 1*b* can come into contact with both of the rollers 22*a* and 22*b* of the feeding roller 2, therefore, skew chain can be suppressed.

Moreover, in the medium feeding device 1*b* in the present embodiment, the following condition is satisfied:

$$n \cdot L2/L1 \leq 0.5$$

where L1 is the overall width of the feeding roller 2 in the direction of the feeding shaft 21, L2 is the width of each of the rollers 22*a* and 22*b* of the feeding roller 2, and n is the number of rollers of the feeding roller 2.

With this configuration, the gap can be appropriately provided between the two rollers 22*a* and 22*b* of the feeding roller 2. Consequently, the internal surfaces of the rollers 22*a* and 22*b* can be prevented from coming into contact with each other, which allows each of the rollers 22*a* and 22*b* to rotate respectively. Namely, the rotation operation of each of the rollers 22*a* and 22*b* can be prevented from being obstructed by the rollers 22*a* and 22*b* coming into contact with each other.

Moreover, the image reading apparatus 10 includes the medium feeding device 1*b*, the image reading unit 5 that is arranged downstream of the medium feeding device 1*b* and reads the image of the medium S, and the control device 7 that corrects skew of the image of the medium S read by the image reading unit 5. Consequently, skew can be corrected by performing the image processing on the image data on the medium S, therefore, the image can be read in a state where the effect of skew of the medium S is further reduced.

Modification of Third Embodiment

The medium feeding device 1*b* in the present embodiment may control driving of the motor 8 such that the circumferential speed of the feeding roller 2 becomes relatively lower than the circumferential speed of the conveying roller 4 instead of the operation of stopping the motor 8 for the feeding roller 2 as the operation when the medium sensors 13 detect the entry of the medium S into the conveying roller 4. In this case, in the operation of the medium feeding device 1*b* illustrated in FIGS. 11 to 13, switching of the motor 8 from "drive" to "stop" in accordance with the detection by the medium sensors 13 is changed to switching from "drive" to "deceleration".

Fourth Embodiment

Figure 15:
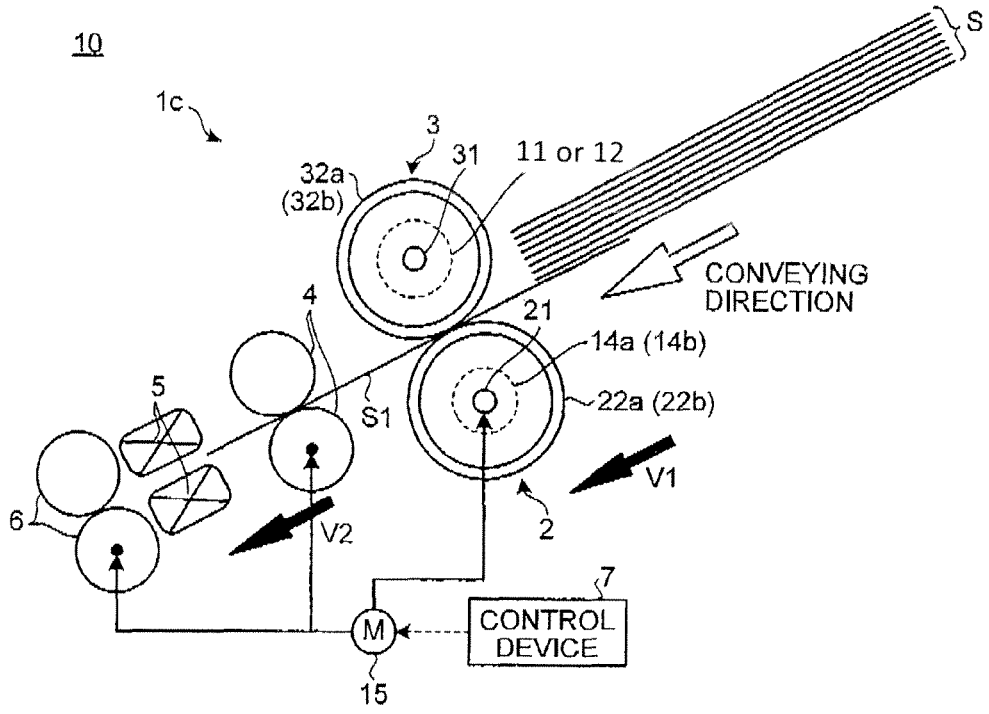
FIG. 15 is a cross-sectional view that illustrates a schematic configuration of an image reading apparatus on which a medium feeding device according to a fourth embodiment of the present invention is mounted.
Figure 16:
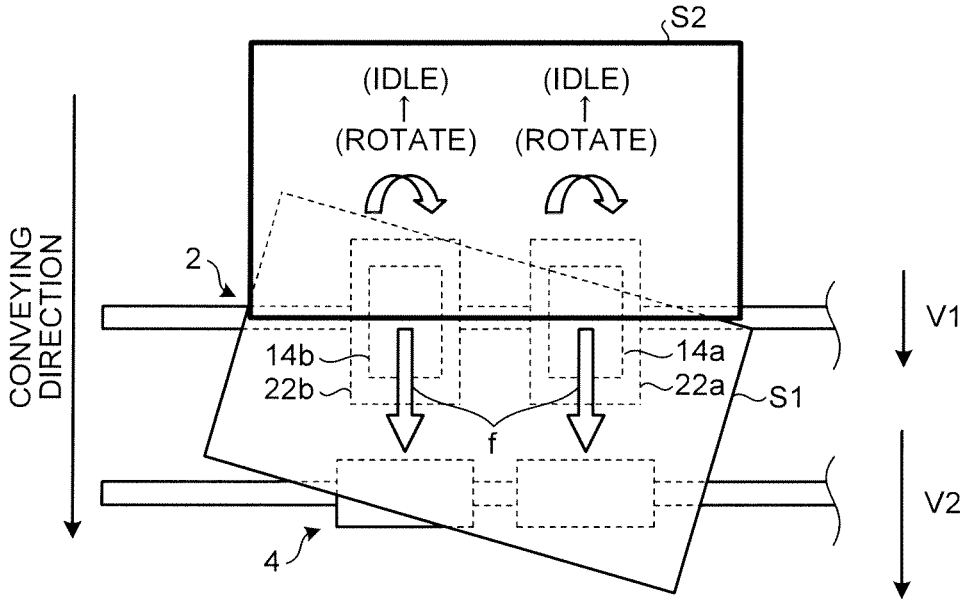
FIG. 16 is a plan view for explaining the suppression operation of skew chain by the medium feeding device according to the fourth embodiment of the present invention.
Figure 17:
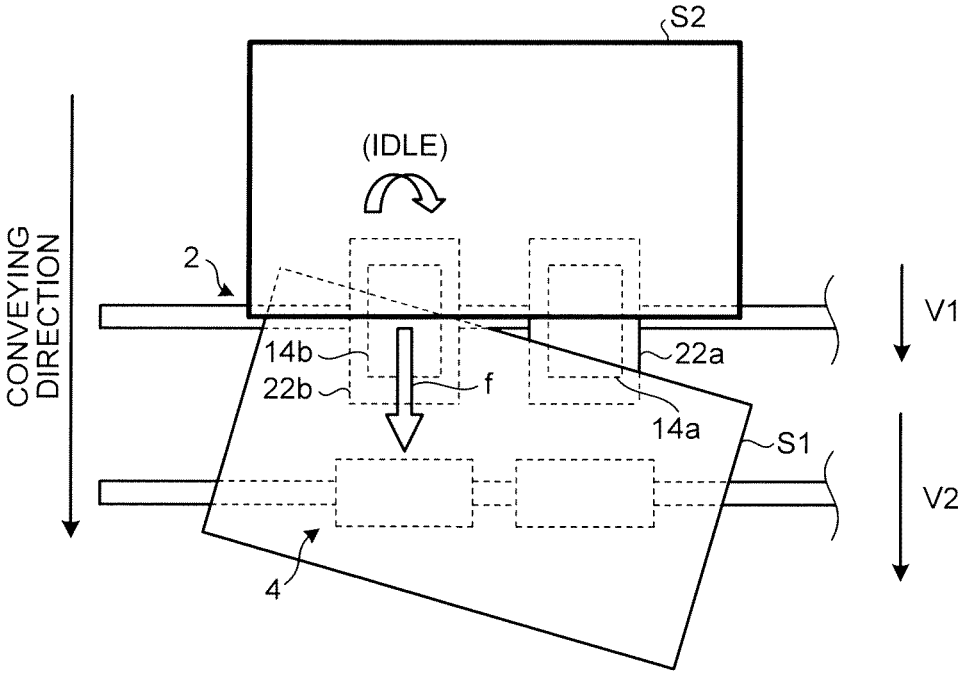
FIG. 17 is a plan view for explaining the suppression operation of skew chain by the medium feeding device according to the fourth embodiment of the present invention.
Figure 18:
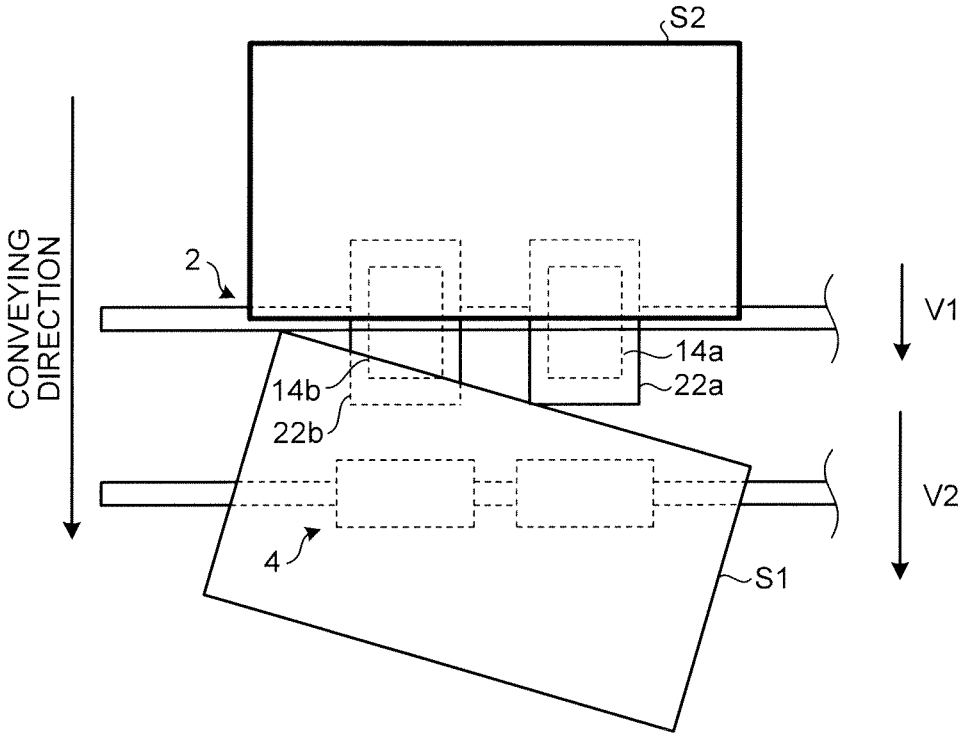
FIG. 18 is a plan view for explaining the suppression operation of skew chain by the medium feeding device according to the fourth embodiment of the present invention.

Next, a fourth embodiment of the present invention is described with reference to FIGS. 15 to 18. FIG. 15 is a cross-sectional view that illustrates a schematic configuration of an image reading apparatus on which a medium feeding device according to the fourth embodiment of the present invention is mounted. FIGS. 16 to 18 are plan views for explaining the suppression operation of skew chain by the medium feeding device according to the fourth embodiment of the present invention.

As illustrated in FIG. 15, a medium feeding device 1*c* of the present embodiment is different from the medium feeding device 1*b* of the third embodiment in that (1) it controls the feeding roller 2 and the conveying roller 4 by a single motor 15 and (2) it does not include the medium sensor 13 that detects the entry of the medium S into the conveying roller 4.

The motor 15 is connected to the feeding roller 2 and the conveying roller 4 via different gear trains, i.e., trains of gears (not shown), respectively, to drive the feeding roller 2 to rotate at a rotational speed V1 and drive the conveying roller 4 to rotate at a rotational speed V2. The rotational speeds V1 and V2 are variable in accordance with the driving force of the motor 15 controlled by the control device 7, however, the relationship V2>V1 is always maintained. In other words, in the medium feeding device 1*c*, the control device 7 can control the circumferential speed of the feeding roller 2 to be relatively lower than the circumferential speed of the conveying roller 4.

Next, referring to FIGS. 16 to 18, the operation of the medium feeding device 1*c* is explained. The positional relationship between the feeding roller 2, the conveying roller 4, and the media S1 and S2 in FIGS. 16 to 18 is similar to that in FIGS. 11 to 13.

The feeding roller 2 is driven to rotate at the circumferential speed V1 by the motor 15 in the direction in which the medium S is sent out in the conveying direction. The conveying roller 4, arranged downstream side in the conveying direction with respect to the feeding roller 2, is also driven to rotate at the circumferential speed V2 by the motor 15 in the direction in which the medium S is sent out in the conveying direction. In this case, as illustrated in FIG. 16, a case is considered in which the first medium S1 among the stacked media S is inserted into the feeding roller 2 in a skewed condition for some reason.

When the medium S1 is inserted into the feeding roller 2, the circumferential surfaces of the two rollers 22*a* and 22*b* of the feeding roller 2 directly come into contact with the inserted medium S1. As illustrated in FIG. 16, when the feeding roller 2 that is in contact with the medium S1 is rotationally driven, the medium S1 receives a frictional force in the conveying direction from the circumferential surfaces of the rollers 22*a* and 22*b*. Consequently, the medium S1 is sent out to the downstream side in the conveying direction by the frictional force. At this time, the second medium S2 staked on the medium S1 is not in contact with the feeding roller 2 because the medium S1 is present between the medium S2 and the feeding roller 2. Therefore, the force in the conveying direction is not transmitted to the medium S2.

When the medium S1 has reached the conveying roller 4, the medium S1 is sent out in the conveying direction by the feeding roller 2 driven to rotate at the circumferential speed V1 and the conveying roller 4 driven to rotate at the circumferential speed V2, concurrently. Since V2>V1 is satisfied, at this time, the medium S1 moves toward the conveying roller 4 side at a relative speed V2−V1 with reference to the feeding roller 2.

The circumferential surfaces of the rollers 22*a* and 22*b* of the feeding roller 2 receive the frictional force f in the conveying direction by the movement of the medium S1 in the conveying direction. This frictional force f acts in the same direction as the direction of the frictional force that the medium S1 receives from the rollers 22*a* and 22*b* by the rotation of the motor 15. The one-way clutches 14*a* and 14*b*, which are arranged between the rollers 22*a* and 22*b* and the feeding shaft 21, can be rotated by the frictional force f. Therefore, both of the rollers 22*a* and 22*b* are idled by the frictional force f and rotate along with the rotation of the conveying roller 4, whereby the medium S1 is sent out in the conveying direction.

When delivery of the medium S1 by the conveying roller 4 proceeds, the medium S1 leaves the feeding roller 2 and the second medium S2 is transitioned to the state of being in contact with the feeding roller 2. As described above, the medium S1 is skewed. In the process of sending out the skewed medium S1 to the conveying roller 4 side, as illustrated in FIG. 17, the state occurs where one of the feeding roller 2, i.e., the roller 22*a*, first separates from the medium S1 and the other of the feeding roller 2, i.e., the roller 22*b*, remains in contact with the medium S1. In other words, the medium S1 has passed through the nip of one of the feeding roller 2, i.e., the roller 22*a*, and is in the nip of the other of the feeding roller 2, i.e., the roller 22*b*.

In this state, since the roller 22*a* through which the medium S1 has first passed does not receive the frictional force f in the conveying direction from the medium S1, the roller 22*a* does not rotate along with the rotation of the conveying roller 4. Furthermore, since the one-way clutch 14*a* restricts the rotation in the direction counter to the conveying direction, even if the medium S2 receives the rotational load from the brake roller 3, the roller 22*a* does not rotate in the counter direction by this rotational load. Therefore, the behavior where the medium S2 is returned in the direction counter to the conveying direction does not occur.

On the other hand, since the roller 22*b* that is in contact with the medium S1 receives the frictional force f in the conveying direction by the medium S1, the roller 22*b* is idled by the frictional force f and keeps rotating along with the rotation of the conveying roller 4. Since the medium S1 is still present between the medium S2 and the roller 22*b*, the medium S2 is not in contact with the roller 22*b* and the frictional force f in the conveying direction is not transmitted to the medium S2.

Then, as illustrated in FIG. 18, after the medium S1 passes through the nip of both of the rollers 22*a* and 22*b*, the medium S2 is inserted into both of the rollers 22*a* and 22*b* substantially at the same time while maintaining the posture in which the width direction thereof is substantially orthogonal to the conveying direction. Accordingly, the medium S2 is inserted into both of the rollers 22*a* and 22*b* without the skew of the medium S1 being transferred to the medium S2.

In this manner, the medium feeding device 1*c* in the present embodiment includes the feeding roller 2 that includes the two rollers 22*a* and 22*b* that rotate by the torque from a single driving unit (the motor 15) transmitted to one feeding shaft 21 and convey the medium S1 in the conveying direction, the brake roller 3 that causes a predetermined conveyance load to act on the medium S2 that has entered between the feeding roller 2 and the brake roller 3 by being in pressure-contact with the feeding roller 2, and the conveying roller 4 that is arranged downstream side in the conveying direction with respect to the feeding roller 2. In the medium feeding device 1*c*, the one-way clutches 14*a* and 14*b* are arranged between each of the rollers 22*a* and 22*b* and the feeding shaft 21. The one-way clutches 14*a* and 14*b* allow the rollers 22*a* and 22*b* to rotate in the conveying rotation direction in which the medium S1 is conveyed in the conveying direction and restrict the rollers 22*a* and 22*b* to rotate in the direction counter to the conveying rotation direction. Moreover, the medium feeding device 1*c* can control the circumferential speed V1 of the feeding roller 2 to be relatively lower than the circumferential speed V2 the conveying roller 4 by the motor 15.

With such a configuration, even when the medium S1 with a skew has entered the conveying roller 4 from the feeding roller 2, as explained with reference to FIGS. 16 to 18, the right and left rollers 22*a* and 22*b* perform different behaviors in accordance with the contact state of the rollers 22*a* and 22*b* and the medium S1. Therefore, skew can be suppressed from being transferred to the medium S2 to be fed next and thus skew chain can be suppressed in a similar manner to the medium feeding device 1*b* in the third embodiment.

Although the medium feeding device 1*c* in the present embodiment does not include the medium sensor 13, the medium feeding device 1*c* may include the medium sensor 13. In this case, the medium sensor 13 is used other than the control driving of the feeding roller 2.

Fifth Embodiment

Figure 19:
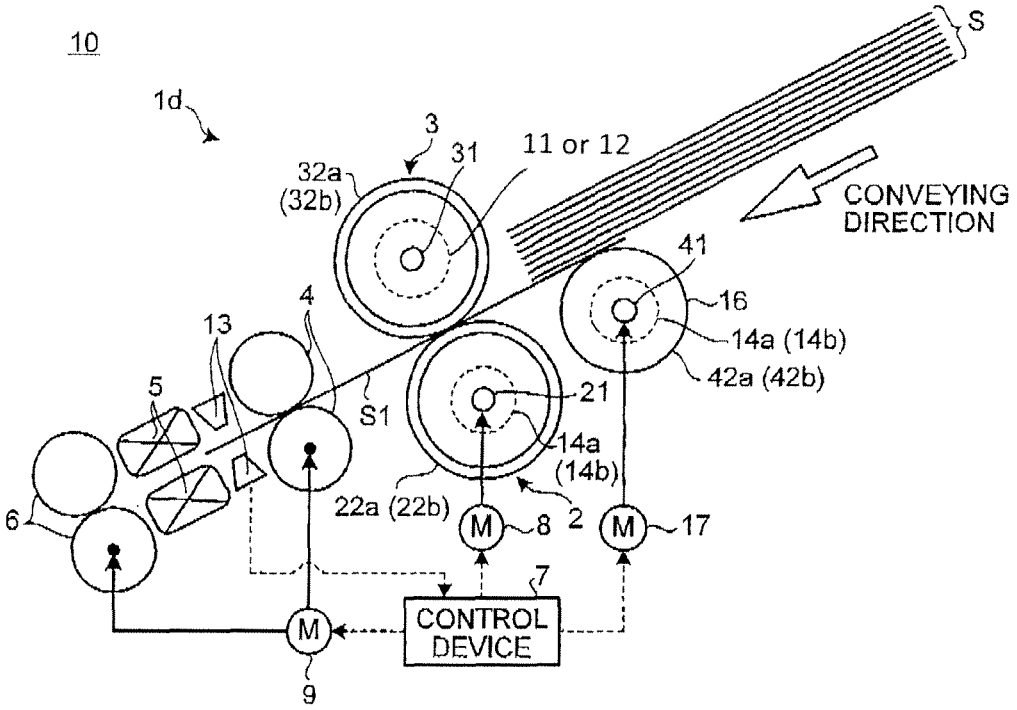
FIG. 19 is a cross-sectional view that illustrates a schematic configuration of an image reading apparatus on which a medium feeding device according to a fifth embodiment of the present invention is mounted.

Next, a fifth embodiment of the present invention is described with reference to FIG. 19. FIG. 19 is a cross-sectional view that illustrates a schematic configuration of an image reading apparatus on which a medium feeding device according to the fifth embodiment of the present invention is mounted.

As illustrated in FIG. 19, a medium feeding device 1*d* in the present embodiment is different from the medium feeding device 1*b* in the third embodiment and the medium feeding device 1*c* in the fourth embodiment in that it includes a pickup roller 16 on the upstream side of the feeding roller 2 in the conveying direction.

The pickup roller 16 is a roller for sending out the lowermost medium S1 that is the conveyance target from among the stacked media S in the conveying direction. The pickup roller 16 includes a rotating shaft 41 arranged substantially orthogonal to the conveying direction and two rollers 42*a* and 42*b* arranged around the rotating shaft 41. The rotating shaft 41 is arranged below the conveyance path of the medium S and is driven to rotate by the operation of a motor 17 controlled by the control device 7. The rollers 42*a* and 42*b* are arranged successively in the direction substantially orthogonal to the conveying direction and are each, for example, formed in a cylindrical shape in which an inner layer thereof is made of a soft material, such as, rubber foam so that a nip width may be easily formed. The circumferential surfaces of the rollers 42*a* and 42*b* can come into contact with the medium S1 that is the conveyance target from below. The pickup roller 16 rotates by the driving force transmitted to the rotating shaft 41 from the motor 17 and can send out the medium S1 in the conveying direction by coming into contact with the medium S1 that is the conveyance target from below.

Then, in a similar manner to the feeding roller 2, the one-way clutches 14*a* and 14*b* (rotation restricting unit) are provided between the two rollers 42*a* and 42*b* included in the pickup roller 16, respectively, and the rotating shaft 41.

With this configuration, even when the medium S1 that has entered the feeding roller 2 from the pickup roller 16 is skewed, the right and left rollers 42*a* and 42*b* perform different behaviors in accordance with the contact state of the rollers 42*a* and 42*b* of the pickup roller 16 and the medium S1. Therefore, skew can be suppressed from being transferred to the medium S2 to be fed next and thus skew chain can be further suppressed.

Although the embodiments of the present invention have been described, the above embodiments are presented as examples only and are not intended to limit the scope of the invention. These embodiments can be practiced in various other forms, and various omissions, replacements, and modifications can be made without departing from the spirit of the invention. These embodiments and modifications thereof are included in the scope and spirit of the invention as well as in the invention described in the claims and their equivalents.

For example, in the above-mentioned embodiments, the torque limiter 11 and the differential gear 12 are recited as examples of the rotational difference generating unit that generates a rotational difference between the roller 32*a* and the roller 32*b* so that the conveyance load acting on the medium S by the rollers 32*a* and 32*b* included in the brake roller 3 becomes even. However, a different component capable of generating a rotational difference between the rollers 32*a* and 32*b* may be applied.

Moreover, the above-mentioned embodiments show a configuration where the number of rollers included in each of the feeding roller 2, the brake roller 3, and the pickup roller 16 is two. However, three or more rollers may be included in each of the feeding roller 2, the brake roller 3, and the pickup roller 16. In other words, each of the feeding roller 2, the brake roller 3, and the pickup roller 16 may include at least two rollers.

When the brake roller 3 is configured to include three or more rollers, the rollers of the brake roller 3 are divided in the axial direction into two groups that are considered as two roller groups each including one or more rollers. These two roller groups are also described as "one roller" and "another roller". In this case, the rotational difference generating unit (the torque limiter 11 or the differential gear 12) can be configured to generate a rotational difference between the one roller and the other roller so that the conveyance load acting on the medium S by one roller and the other roller becomes even.

Moreover, a dummy roller, which does not generate the conveyance load, may be provided at least at one portion between rollers that are included in the brake roller 3 and generate the conveyance load.

Moreover, the rollers provided with the one-way clutches 14*a* and 14*b* may be a roller on the most upstream of the conveyance path of the medium S. In this case, as in the medium feeding device 1*b* in the third embodiment and the medium feeding device 1*c* in the fourth embodiment, when the most upstream roller on the conveyance path of the medium S is the feeding roller 2, the feeding roller 2 is provided with the one-way clutches 14*a* and 14*b*. Moreover, as in the medium feeding device 1*d* in the fifth embodiment, when the pickup roller 16 is arranged upstream of the feeding roller 2, the most upstream roller on the conveyance path of the medium S is the pickup roller 16, therefore, the pickup roller 16 is provided with the one-way clutches 14*a* and 14*b*.

Moreover, the above-mentioned embodiments are described in connection with, for example, the medium feeding device of a type which supplies, as the conveyance target, the lowermost medium S1 of one sheet among a plurality of media S stacked on the hopper called lower extraction type. However, the present invention can be applied to the medium feeding device of the upper extraction type which feeds the uppermost medium among the media S stacked on the hopper as a conveyance target.

Moreover, the above-mentioned embodiments are described in connection with, for example, the medium feeding device employing a center paper feeding reference system in which the medium S is supplied with the central position of the medium S in the width direction orthogonal to the conveying direction as a reference position. However, the present invention can be also applied to a medium feeding device employing a one side feeding medium in which one end side in the width direction orthogonal to the conveying direction is set as a reference position.

The present invention is achieved in view of the above and has an object to provide a medium feeding device capable of reducing a skewed condition of a medium at low cost and with a simple configuration.

The medium feeding device according to the present invention has the advantages that when skew of a medium occurs, a rotational difference is generated between the rollers of the brake roller by the rotational difference generating unit due to a difference in torque received by the rollers and therefore the skew of the medium is reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A medium feeding device comprising:

a feeding roller that conveys a medium in a conveying direction;

a brake roller that includes a first roller and a second roller that are arranged to be independently rotatable around one shaft and cause a conveyance load to act on the medium that has entered between the feeding roller and the brake roller, the brake roller being arranged to press the feeding roller with a predetermined pressure, each of the first roller and the second roller being independently controlled whether to rotate along with rotation of the feeding roller or generate a rotational load in accordance with a torque received by each of the first roller and the second roller; and a rotational difference generating unit that generates a rotational difference between the first roller and the second roller so that the conveyance load acting on the medium by the first roller and the second roller becomes even, the rotational difference generating unit including a first rotational difference generating unit and a second rotational difference generating unit, wherein the first roller and the second roller include therein the first rotational difference generating unit and the second rotational difference generating unit, respectively.

2. The medium feeding device according to claim 1, wherein the rotational difference generating unit is a differential gear provided between the first roller and the second roller of the brake roller.

3. The medium feeding device according to claim 1, wherein the rotational difference generating unit is torque limiters connected to the rollers of the brake roller, respectively.

4. The medium feeding device according to claim 1, further comprising:

a conveying roller arranged downstream of the feeding roller in the conveying direction, the feeding roller including at least two rollers that rotate by a torque from a single driving unit transmitted to one feeding shaft and convey the medium in the conveying direction; and a rotation restricting unit that is respectively arranged between a feeding shaft and each of the rollers included in the feeding roller, and allows the feeding roller to rotate in a conveying rotation direction in which the medium is conveyed in the conveying direction and restricts the feeding roller to rotate in a direction counter to the conveying rotation direction, wherein the driving unit is configured to drive the feeding roller and the conveying roller such that a circumferential speed of the feeding roller is relatively lower than a circumferential speed of the conveying roller.

5. The medium feeding device according to claim 1, wherein an overall width of the brake roller in the axial direction is smaller than a width of a medium to be fed.

* * * * *